US008396224B2

(12) United States Patent
Dittberner

(10) Patent No.: US 8,396,224 B2
(45) Date of Patent: Mar. 12, 2013

(54) METHODS AND APPARATUSES FOR SETTING A HEARING AID TO AN OMNIDIRECTIONAL MICROPHONE MODE OR A DIRECTIONAL MICROPHONE MODE

(75) Inventor: Andrew Burke Dittberner, Antioch, IL (US)

(73) Assignee: GN ReSound A/S, Ballerup (DK)

( * ) Notice: Subject to any disclaimer, the term of this patent is extended or adjusted under 35 U.S.C. 154(b) by 1067 days.

(21) Appl. No.: 12/281,502

(22) PCT Filed: Mar. 2, 2007

(86) PCT No.: PCT/DK2007/000106
§ 371 (c)(1),
(2), (4) Date: Jan. 20, 2009

(87) PCT Pub. No.: WO2007/098768
PCT Pub. Date: Sep. 7, 2007

(65) Prior Publication Data

US 2009/0304187 A1 Dec. 10, 2009

Related U.S. Application Data

(60) Provisional application No. 60/778,775, filed on Mar. 3, 2006.

(30) Foreign Application Priority Data

Mar. 3, 2006 (DK) ..... 2006 00317

(51) Int. Cl.
*H04R 25/00* (2006.01)

(52) U.S. Cl. ..... 381/23.1

(58) Field of Classification Search ..... 381/23.1
See application file for complete search history.

(56) References Cited

U.S. PATENT DOCUMENTS
(Continued)

FOREIGN PATENT DOCUMENTS

DE 10114101 A1 6/2002
EP 0664071 B1 7/2009

(Continued)

OTHER PUBLICATIONS

T. Houtgast et al.; "Prediciting Speech Intelligibility in Rooms From the Modulation transfer Function"; General Room Acoustics; 1980; pp. 60-72; vol. 46; Acoutica.

(Continued)

*Primary Examiner* — Ori Nadav
(74) *Attorney, Agent, or Firm* — Vista IP Law Group, LLP

(57) ABSTRACT

The present invention pertains to a method of automatic switching between omnidirectional (OMNI) and directional (DIR) microphone modes in a binaural hearing aid comprising a first microphone system for the provision of a first input signal, a second microphone system for the provision of a second input signal, where the first microphone system is adapted to be placed in or at a first ear of a user, the second microphone system is adapted to be placed in or at a second ear of said user, the method comprising a measurement step, where the spectral and temporal modulations of the first and second input signal are monitored, an evaluation step, where the spectral and temporal modulations of the first and second input signal are evaluated by the calculation of an evaluation index of speech intelligibility for each of said signals, and an operational step, where the microphone mode of the first and the second microphone systems of the binaural hearing aid are selected in dependence of the calculated evaluation indexes.

24 Claims, 8 Drawing Sheets

U.S. PATENT DOCUMENTS

Figure 1:
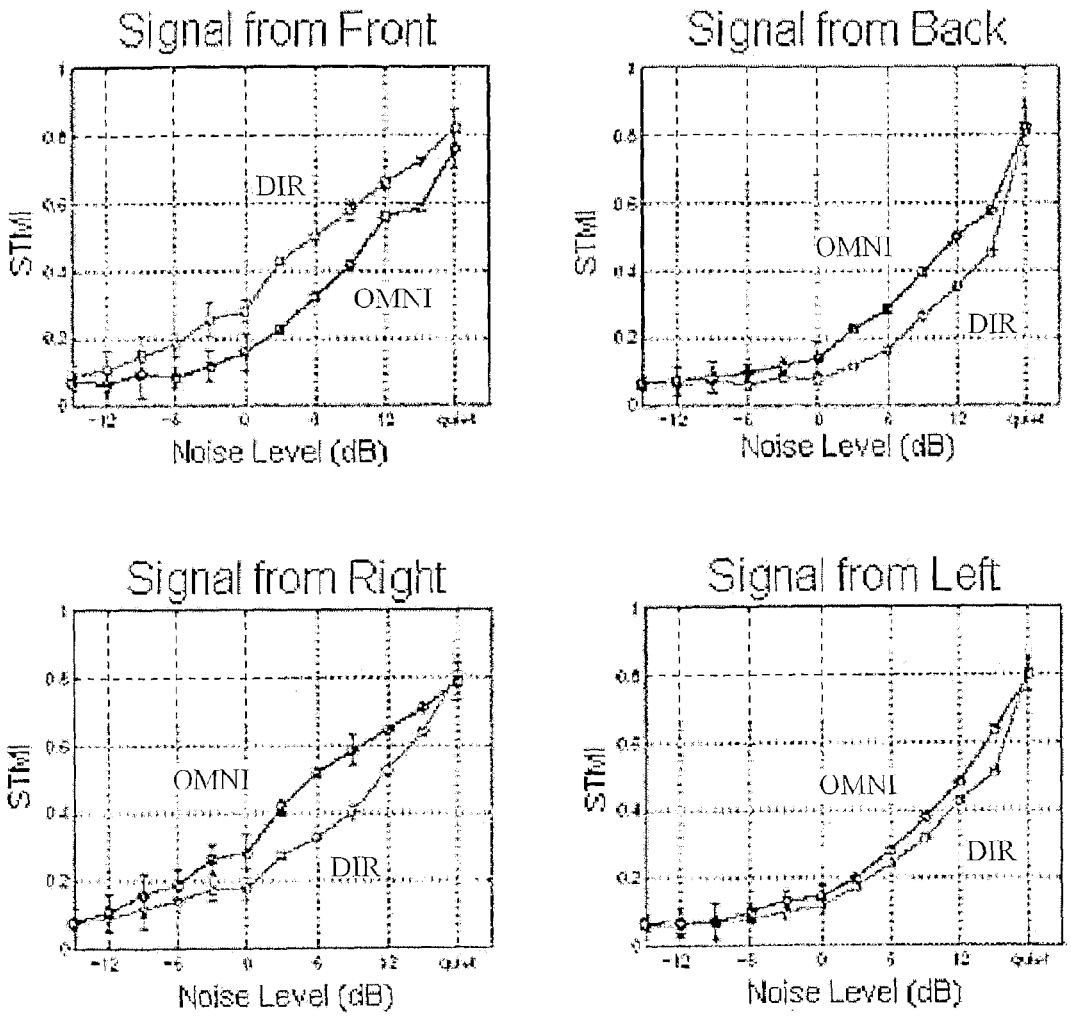

| | | | | |
|---|---|---|---|---|
| 6,327,370 | B1 | 12/2001 | Killion et al. | |
| 6,912,289 | B2 * | 6/2005 | Vonlanthen et al. | 381/312 |
| 7,688,990 | B2 * | 3/2010 | Hellgren et al. | 381/312 |
| 7,986,790 | B2 * | 7/2011 | Zhang et al. | 381/60 |
| 8,068,627 | B2 * | 11/2011 | Zhang et al. | 381/313 |
| 2002/0061047 | A1 | 5/2002 | Fish et al. | |
| 2002/0191799 | A1 * | 12/2002 | Nordqvist et al. | 381/60 |
| 2003/0044034 | A1 * | 3/2003 | Zeng et al. | 381/317 |
| 2003/0112987 | A1 * | 6/2003 | Nordqvist et al. | 381/312 |
| 2004/0013280 | A1 | 1/2004 | Niederdrank | |

FOREIGN PATENT DOCUMENTS

| | | | |
|---|---|---|---|
| JP | 2004-500750 | A | 1/2004 |
| JP | 2004-535082 | A | 11/2004 |
| WO | 0176321 | | 10/2001 |
| WO | 0230156 | | 4/2002 |
| WO | 2004114722 | | 12/2004 |
| WO | 2004114722 | A1 | 12/2004 |
| WO | 2005 029914 | A1 | 3/2005 |
| WO | 2005084074 | A2 | 9/2005 |

OTHER PUBLICATIONS

International Search Report and Written Opinion for corresponding application PCT/DK2007/000106, dated Jun. 21, 2007.

Brian E. Walden et al ; "Predicting Hearing Aid Microphone Preference in Everyday Listening"; Journal of the American Academy of Audiology; 2004; pp. 361-390; vol. 15, No. 5.

Mary T. Cord et al.; "Performance of Directional Microphone Hearing Aids in Everyday Life"; Journal of the American Academy of Audiology; 2002; pp: 295-307; vol. 13, No. 6.

Karl D. Kryter; "Mehtods for the Calculation and Use of the Articulation Index"; The Journal of the Acoustical Society of America; Nov. 1962; pp. 1689-1697; vol. 34, No. 11; Bolt Beranek and Newman Inc., Cambridge, Massachusetts.

Ken W. Grant et al.; "Prediciting OMNI/DIR Microphone Preferences"; American Academy of Audiology; Mar. 30-Apr. 2, 2005; pp. 28; Washington D.C.

Steeneken H. et al.; "A Physical Method for Measuring Speech-Transmission Quality"; Journal of the Acoustical Society of America; Jan. 1980; pp. 318-326; vol. 67.

"Sound System Equipment" Part 16: Objective Rating of Speech Intelligibility by Speech Transmission Index; 2003; pp. 2-6; IEC 60268-16 Third Edition; Switzerland.

Volker Hohmann et al.; "The Effect of Multichannel Dynamic Compression on Speech Intelligibility"; Journal of the Acoustical Society of America; Feb. 1995; pp. 1191-1195; vol. 97, No. 2.

Brian R. Glasberg et al. "Psychoacustic Abilities of Subjects with Unilateral and Bilateral Cochlear Hearing Impairments and Their Relationship to the Ability to Understand Speech" Scandinavian Audiology; pp. 1-25; Supplementum 32.

Dennis H. Klatt et al.; "Analysis, Synthesis, and Perception of Voice Quality Variations Among Female and Male Talkers"; Journal of the Acoustical Society of America; Feb. 1990; pp. 820-857; vol. 87, No. 2.

N. R. French; "Factors Governing the Intelligibility of Speech Sounds"; Journal of the Acoustical Society of America; Jan. 1947; pp. 90-119; vol. 19, No. 1.

Todd A. Ricketts; "Directional Amplification for Improved Signal-to-Noise Ration: Strategies, Measurements, and Limitations"; In Valente M. ed; Hearing Aids: Standards, Options and Limitations, Second Edition; Thieme Medical Publishers; 2002; pp. 274-346; New York. Part 1.

Todd A. Ricketts; "Directional Amplification for Improved Signal-to-Noise Ration: Strategies, Measurements, and Limitations"; In Valente M. ed; Hearing Aids: Standards, Options and Limitations, Second Edition; Thieme Medical Publishers; 2002; pp. 274-346; New York. Part 2.

* cited by examiner

METHODS AND APPARATUSES FOR SETTING A HEARING AID TO AN OMNIDIRECTIONAL MICROPHONE MODE OR A DIRECTIONAL MICROPHONE MODE

CROSS REFERENCE TO RELATED APPLICATIONS

This application is the national phase under 35 U.S.C. 371 of PCT International Application No. PCT/DK2007/000106 which has an international filing date of Mar. 2, 2007, and also claims priority under 35 U.S.C. 119 to Danish application PA 2006 00317 filed on Mar. 3, 2006, and U.S. Provisional Patent Application No. 60/778,775, filed on Mar. 3, 2006, which applications are hereby incorporated by reference in their entirety for all purposes as if fully set forth herein.

The present invention pertains to a method of automatic switching between omnidirectional (OMNI) and directional (DIR) microphone modes in a binaural hearing aid system comprising, a first microphone system for the provision of a first input signal, a second microphone system for the provision of a second input signal, where the first microphone system is adapted to be placed in or at a first ear of a user, the second microphone system is adapted to be placed in or at a second ear of said user. The invention furthermore, relates to a binaural hearing aid that is adapted to switch automatically between OMNI and DIR microphone modes. The invention furthermore relates to a hearing aid forming part of a binaural hearing aid.

Current hearing aids are capable of both omnidirectional (OMNI) and directional (DIR) processing and newer implementations of OMNI/DIR hearing aids automatically switch between the two microphone processing modes. Both OMNI and DIR processing offer benefits relative the other mode, depending upon the specific listening situation.

For relatively quiet listening situations, OMNI processing is typically preferred over the DIR mode. This is due to the fact that in situations, where any background noise present is fairly low in amplitude, the OMNI mode should provide a greater access to the full range of sounds in the surrounding environment, which may provide a greater feeling of "connectedness" to the environment. The general preference for OMNI processing when the signal source is to the side or behind the listener is predictable. By providing greater access to sound sources that the listener is not currently facing, OMNI processing will improve recognition for speech signals arriving from these locations (e.g., in a restaurant where the server speaks from behind or from the side of listener). This benefit of OMNI processing for target signals arriving from locations other than in front of the listener will be present in both quiet and noisy listening situations. For noisy listening conditions where the listener is facing the signal source (e.g., the talker of interest), the increased SNR provided by DIR processing for signals coming from the front is likely to make DIR processing preferred.

Each of the listening conditions just mentioned (in quiet, in noise with the patient facing or not facing the talker) occur frequently in the everyday experience of hearing-impaired listeners (see for example a study reported in Walden, B. E., Surr, R. K., Cord, M. T., and Dyrlund, O. (2004), Predicting hearing aid microphone preference in everyday listening. Journal of the American Academy of Audiology, 15, 365-396). Thus, hearing aid users regularly encounter listening situations where DIR processing will be preferable to the OMNI mode, and vice versa.

Traditionally, commercial implementations of directional processing require manual switching between the OMNI and DIR microphone modes. The user changes processing modes by flipping a toggle switch or pushing a button on the hearing aid to put the device in the preferred mode according to the listening conditions encountered in a specific environment.

A problem with this approach is that listeners may not be aware that a change in mode could be beneficial in a given listening situation if they do not actively switch modes. In addition, the most appropriate processing mode can change fairly frequently in some listening environments and the listener may be unable to conveniently switch modes manually to handle such dynamic listening conditions. Finally, many listeners may find manual switching and active comparison of the two modes burdensome and inconvenient. As a result, they may leave their devices in the default OMNI mode permanently. In a study reported in Cord, M. T., Surr, R. K., Walden, B. E., Olson, L. (2002), Performance of directional microphones in everyday life, Journal American Academy Audiology, 13, 295-307, it is estimated that about one-third of listeners fitted with manually switchable OMNI/DIR hearing aids may leave their instruments in the default mode regardless of the listening situation. Obviously these patients cannot benefit from the (unused) DIR processing mode.

Recently, several hearing aid manufacturers have introduced hearing aids that automatically switch between OMNI and DIR microphone modes based on some analysis of the acoustic environment. Automatic switching avoids many of the problems associated with manual switching mentioned above. Here, acoustic analysis of the input signal is carried out to determine whether OMNI or DIR processing is likely to be preferred, and the device automatically selects the appropriate mode based on the analysis. Examples of hearing aids that are capable of automatically switching between OMNI and DIR microphone modes are described in the below mentioned patent documents.

In WO 2004114722 a binaural hearing aid system with coordinated sound processing is disclosed, where switching between OMNI and DIR microphones is based on environment classification.

EP 0664071 relates to a hearing aid having a microphone switching system that uses directional microphones for a hearing aid apparatus that is used in circumstances where the background noise renders verbal communication difficult. The invention relates also to switching between an omnidirectional microphone and a directional microphone system, based on the measured ambient-noise-level.

U.S. Pat. No. 6,327,370 relates to various techniques of automatic switching between OMNI and DIR microphones according to different noise conditions.

These automatic decisions of switching the microphone modes are all more or less based on rules associated with the level of ambient noise and/or whether a modulated signal, such as speech, is present. However, whether directional microphones are chosen manually by the listener or automatically by the hearing instrument, directional microphones perform a lossy coding of the sound (basically a spectral subtraction occurs by phase shifting one of two signals before addition), eliminating spectral information based on the direction of arrival of the sound. Once this information is removed, it is no longer available or retrievable by the hearing instrument or listener.

Thus, one of the major problems with such methods of manual or automatic switching of microphone modes is the elimination of information, which occurs when the hearing instrument is set to a bilateral directional microphone mode, which may be important to the listener. Though the purpose of a directional microphone is to provide a better signal-to-noise ratio for the signal of interest, the decision of what is the signal of interest is ultimately the listener's choice and cannot be decided upon by the hearing instrument. As the signal of interest is assumed to occur in the look direction of the listener (and on-axis to the directional microphone) any signal that occurs outside the look direction of the listener can and will be eliminated by the directional microphone.

This is in compliance with clinical experience, which suggests that automatic switching algorithms like those discussed above and those currently being marketed are not achieving wide acceptance (see for example: Cord, M. T., Surr, R. K., Walden, B. E., Olson, L. (2002). Performance of directional microphones in everyday life. Journal American Academy Audiology, 13, 295-307). Patients generally prefer to switch modes manually rather than rely of the decisions of these algorithms.

It is thus an object of the present invention to provide an improvement in the processing algorithms and decision strategies used in automatic switching algorithms, which are necessary in order to improve their performance and acceptance (by the hearing aid user) in the future.

It is a further object of the present invention to provide a binaural hearing aid system with an improved processing algorithm and decision strategy used for automatic switching between ONMI and DIR microphone modes that are necessary to improve their performance and acceptance (by the hearing aid user) in the future.

According to the present invention, the above-mentioned and other objects are fulfilled by a method of automatic switching between omnidirectional (OMNI) and directional (DIR) microphone modes in a binaural hearing aid system, which binaural hearing aid comprises a first microphone system for the provision of a first input signal, a second microphone system for the provision of a second input signal, where the first microphone system is adapted to be placed in or at a first ear of a user, the second microphone system is adapted to be placed in or at a second ear of said user, and where the method comprises,

- a measurement step, where the spectral and temporal modulations of the first and second input signal are monitored,
- an evaluation step, where the spectral and temporal modulations of the first and second input signal are evaluated by the calculation of an evaluation index, preferably of speech intelligibility, for each of said signals,
- an operational step, where the microphone mode of the first and the second microphone systems of the binaural hearing aid are selected in dependence of the calculated evaluation indexes.

By monitoring the spectral and temporal modulations of the input signals from the two microphone systems, in the measurement step, a very rich representation of the ambient sound environment is achieved, that is sensitive to even small changes in the fidelity of a speech signal. Thus, the effects of additive noise, reverberation, and phase distortion can be observed. Scientific investigations (to be presented at the American Auditory Society conference Mar. 5, 2006) show that based on an evaluation of these spectral and temporal modulations it is, to a high degree of accuracy, possible to predict OMNI/DIR user preferences, i.e. it is based on the information contained in the spectral and temporal modulations of the input signals possible to predict if a user prefers an OMNI microphone mode or a DIR microphone mode. Furthermore, the scientific investigations show that it is possible to predict user preferences for which of the two microphone systems should operate in an OMNI mode, and which of the two microphone systems should operate in a DIR mode. Furthermore, it is to a certain degree possible to predict those situations, where the user would benefit from a symmetric binaural fit. The evaluation of the spectral and temporal modulations of the input signals may be achieved by the calculation of an evaluation index (EI) for both signals.

Since the method according to the invention is used in a binaural hearing aid the method provides the user with a processing that closely resembles, but without replacing, the signal processing that is conducted in the human auditory system (most importantly it provides two channels of acoustic information), which naturally starts with two channels of acoustic translated neural information that originate through its peripheral components, namely the cochlea and associated structures. Frequency, time, and intensity components of the acoustic signal are neural coded. Low level processing of the auditory signal results in tonotopical separation of the signal (re: frequency), temporal coding, and other low level functions. Of interest to this invention are the following auditory processes: Sequential stream segregation, Spectral integration, and Inhibition. Sequential stream segregation is the auditory system's ability to group common temporal and spectral patterns allowing for separate streams of information to exist concurrently. Spectral integration allows for correlated signals, differing slightly in time, to be fused as a single perception (e.g. time aligning two spectrally similar signals and adding them together to make one signal). Inhibition is the ability of the listener to ignore an auditory stream of information.

If the ambient sound environment, wherein the desired speech signal emanates from is substantially quiet, then the EI would generally be high, and the scientific investigations suggested that users generally preferred an OMNI mode in both microphone systems of the binaural hearing aid. On the other hand, if the ambient sound environment, wherein the desired speech signal emanates from contained at least one other speech signal, then the EI would generally be lower than in the first case, and the scientific investigations showed that the users generally preferred an OMNI mode in one of the microphone systems of the binaural hearing aid and a DIR mode in the other (contralateral) microphone system. The user's preferences of such an asymmetrical microphone configuration, with one microphone system in OMNI operational mode, and the other in DIR operational mode, is due to the fact that the human brain is to a certain extent able to focus on those speech signals that are important to the user. The situation is very similar to those people who fit one of their eyes with a "far vision" contact lens and the other with a "near vision" contact lens. The brain of the user of the contact lenses then mixes the information in the sensed light in such a way that the user will be able to see more than he or she would if he or she uses only one of the types of lenses. Thus, if we do an asymmetric bilateral processing of the sound, we allow for the brain to segregate the different sounds, inhibit the unwanted segregated sounds and integrate the remaining wanted segregated sounds. This idea is all about how the brain streams auditory information (i.e. identifies sound objects and chooses to ignore them). If we allow for a signal with a better SNR (focused) and a signal with all environmental sound information (peripheral), this allows for the brain to compare both channels (i.e. the auditory information that is present in both the first input signal and the second input signal) and segregate the audio information so as to allow the end user to decide what is a relevant sound and what is not. This could not happen if we had two directional systems on simultaneously and the signal of interest existed behind or beside the listener.

Thus, the inventive method of calculating and evaluating the spectral and temporal modulations in the two input signals of a binaural hearing aid assists the user's auditory system to group and segregate streams of auditory information, inhibit one or more auditory streams, and fuse the remaining streams into a single, binaural image. Furthermore, by manipulating the bilateral signal processing strategies in the binaural hearing aid the user is provided with the choice to define which auditory stream contains the signal of interest while allowing the user to inhibit the auditory streams containing irrelevant or unwanted information (i.e. noise). Further, providing one of the two channels of the auditory system with information from a directional microphone processed input signal allows for a better signal-to-noise ratio (SNR) ultimately leading to improved speech intelligibility in noise.

The scientific investigations show that only in those noisy situations where the desired speech signal is coming substantially from the front of the user, he or she preferred a DIR mode, wherein the scientific investigations showed that the preference of DIR mode was strongly correlated to those situations where the EI was low. Accordingly the scientific investigations showed that it was possible to predict user preferences to a high degree of accuracy, by monitoring and evaluating the spectral and temporal modulations of the input signals, and that it was even possible to predict the preferred microphone mode (OMNI or DIR) in each of the two microphone modes, by an evaluation of the spectral and temporal modulations of the two input signals.

The evaluation step according to the inventive method may in a preferred embodiment further comprise a comparison of the evaluation indexes of the two input signals with a first threshold value, e.g. a predetermined first threshold value. Hereby is achieved a simple way to predict whether a user prefers the binaural hearing aid to operate in a OMNI mode in both microphone systems, or whether the user prefers that at least one of the microphone systems should operate in a DIR mode. The scientific investigations showed that an OMNI mode preference for both microphone systems was strongly correlated with a high EI as measured in both of the first and second input signals.

The evaluation step according to a further preferred embodiment of the inventive method may furthermore comprise a calculation of the difference between the two evaluation indexes and a comparison of this difference with a second threshold value, e.g. a predetermined second threshold value. Hereby it is achieved that it is possible to compare the EI for each input signal with each other, and by furthermore comparing it to a second threshold value it is possible to evaluate whether a default asymmetric fit (i.e. OMNI mode in one microphone mode and DIR in the other) would be a preferred configuration by a user or whether the user would prefer (and benefit from) a more specific asymmetric fit, i.e. what specific microphone system the user would prefer to operate in an OMNI mode and what microphone system he or she would prefer to operate in a DIR mode. The scientific investigations showed that, when the difference in EI for the two input signals exceeded a certain level, then there was a clear user preference for the microphone configuration wherein the microphone system in which the highest EI was determined from the corresponding input signals, should operate in an OMNI mode. This step is preferably applied only if the EI for the two input signals is below the first threshold value, or else the OMNI mode in both microphone systems was preferable.

The measurement step according to the inventive method may comprise monitoring the spectral and temporal modulations of each of the input signals with at least one of the microphone systems in OMNI mode. Preferably the spectral and temporal modulations of each of the input signals are monitored with both of the microphone systems in the OMNI mode. This configuration is advantageous when the inventive method is used to switch from OMNI microphone mode to an asymmetric fit, i.e. when switching from a mode wherein both microphone systems are in an OMNI mode (i.e. a symmetric $OMNI_{BI}$ mode) to a mode wherein one of the microphone systems is switched to a DIR mode, and the other microphone system is left in the OMNI mode.

In another embodiment the measurement step according to the inventive method may comprise monitoring the spectral and temporal modulations of each of the input signals with one of the microphone systems in OMNI mode and the other microphone systems in DIR mode. This is especially advantageous when the inventive method is used to switch from an asymmetric fit to a symmetric DIR mode, i.e. when switching from a microphone mode wherein one of the microphone systems is in an OMNI mode and the other microphone system is in a DIR mode to a microphone configuration wherein the microphone system which is in the OMNI mode is switched to a DIR mode, i.e. when switching to a microphone configuration wherein both microphone systems are in a DIR mode.

Switching back to a symmetric binaural OMNI mode (i.e. an operational state wherein both microphone systems are in an OMNI mode), from an asymmetric fit or a symmetric binaural directional mode, is preferably determined on the basis of a measurement of the ambient noise level in the surrounding sound environment.

An object of the invention is furthermore achieved by a binaural hearing aid system comprising at least one signal processor, a first microphone system for the provision of a first input signal, a second microphone system for the provision of a second input signal, where the first microphone system is adapted to be placed in or at a first ear of a user, the second microphone system is adapted to be placed in or at a second ear of said user, wherein the at least one signal processor is adapted to perform an evaluation of spectral and temporal modulations of at least one of the input signals, and where the first microphone system is adapted to switch automatically between an OMNI and a DIR microphone mode in dependence of said evaluation.

An even further object of the invention is achieved by a hearing aid comprising a signal processor and a microphone system for the provision of an input signal, wherein the hearing aid is adapted for forming part of a binaural hearing aid system and for receiving information from another hearing aid also forming part of the binaural hearing aid system, and where the signal processor is adapted to perform an evaluation of spectral and temporal modulations of the input signal, and where the microphone system is adapted to switch automatically between an OMNI and a DIR microphone mode in dependence of said evaluation.

It should be understood that a binaural hearing aid is sometimes referred to as a binaural hearing aid system, and that the two equivalent expressions, binaural hearing aid and binaural hearing aid system are used interchangeably throughout this text.

Hereby is achieved a binaural hearing aid, wherein it is possible to choose one asymmetric fit in dependence on the evaluation of the spectral and temporal modulations of the at least one input signal, i.e. where it is possible to switch between OMNI mode and DIR mode in one of the microphone systems in dependence of an evaluation of the spectral and temporal modulations of the at least one, input signal. This way a binaural hearing aid is provided for, wherein the user of said binaural hearing aid is given the advantage of an asymmetric fit (i.e. OMNI mode in one microphone system and DIR in the other), based on a simple evaluation of the spectral and temporal modulations of the at least one input signal.

In a preferred embodiment of the binaural hearing aid system according to the invention, the second microphone system may also be adapted to switch automatically between an OMNI and a DIR microphone mode in dependence of the evaluation of both spectral and temporal modulations of at least one of the input signals. Hereby is achieved a binaural hearing aid wherein the microphone mode (OMNI or DIR) in each of the two microphone systems may be chosen in dependence of the evaluation of both spectral and temporal modulations of at least one of the input signals, preferably both input signals, in order to comply with user preferences in each single situation. Furthermore, the user is hereby given the advantage of a possible symmetric directional fit, i.e. a $DIR_{BI}$ mode (which is a mode wherein both of the microphone systems are switched to a DIR mode), based on an evaluation of the spectral and temporal modulations of the at least one input signal.

Advantageously the evaluation of the spectral and temporal modulations of at least one of the input signals in a binaural hearing aid system according to invention may comprise the calculation of an evaluation index. Such an evaluation index may in a preferred embodiment of the invention be the so called speech transmission index (STI) or a STI modified by for example a speech template (speech model). Other evaluation indexes that may be used are the spectral temporal modulation index (STMI), a modified articulation index (AI), or a modification of the STMI itself.

The STMI is similar to the AI, c. f. Kryter, K. D. (1962). Methods for calculation and use of the articulation index. Journal of the Acoustical Society of America, 34, 1689-1697) or the STI (c. f. Houtgast, T., Steeneken, H. J. M., and Plomp, R. (1980). Predicting speech intelligibility in rooms from the modulation transfer function: I. General room acoustics. Acustica, 46, 60-72) and is further explained in a poster by Grant et al., reported in Grant, K. W., Elhilali, M., Shamma, S. A., Walden, B. E., Cord, M. T., and Dittberner, A. (2005). "Predicting OMNI/DIR microphone preferences," Convention 2005, American Academy of Audiology, Washington, D.C., Mar. 30-Apr. 2, 2005, p. 28.

Like the AI and STI, the STMI is an index, which may be interpreted as a measure of corrupted speech input relative to a model of clean speech. All these indices have a value between 0 and 1 representing the degree to which the input speech is similar to the clean speech model. Common for these indexes is that there is strong predictive relationship between them and speech intelligibility. However, since the STMI is computationally very complicated due to the huge number of features that are extracted, and since there is only a limited processing power available in a hearing aid signal processor, it is preferred to use a modified STI in the binaural hearing aid according to the invention. By using a STI metric or modified STI metric instead of an STMI it may be possible to reduce the number of features used in the calculations to substantially a tenth (1/10) of those features that are necessary when calculating the STMI. Hereby the computational load on the signal processor is reduced, whereby it is readily seen that the corresponding signal processing delay in the binaural hearing aid may be reduced, and hence in a digital implementation of the signal processor, the sample time may be reduced, whereby again a shorter digital Fourier transformation may be used, which again further reduces the number of calculations in said binaural hearing aid.

The binaural hearing aid according to the invention may in one embodiment comprise two housing structures; for the accommodation of each of the two microphone systems, i.e. each of the housing structures may be adopted to comprise one of the two microphone systems. The two housing structures may in one embodiment of the binaural hearing aid according to the invention be adapted to communicate with each other, i.e. be able to send information from one of the housing structures to the other, or be able to send information both ways between the two housing structures. The at least one signal processor may in one embodiment comprise one single signal processor that is located in one of the housing structures or it may comprise two individual signal processors, wherein each of the two housing structures is adapted to comprise one of the two signal processors.

The two housing structures may in one embodiment of the binaural hearing aid according to the invention comprise two ordinary hearing aid shells. Said hearing aid shells may in a preferred embodiment of the binaural hearing aid according to the invention comprise behind-the-ear (BTE), in-the-ear (ITE), in-the-canal (ITC), completely-in-the-canal (CIC) or otherwise mounted hearing aid shells. In an even further embodiment of the binaural hearing aid according to the invention, said binaural hearing aid may merely comprise two ordinary hearing aids known in the art, that both are adapted to communicate with each other and execute a method according to the invention. In a preferred embodiment of the binaural hearing aid according to the invention, the communication between the two housing structures may be wireless.

In another embodiment of the binaural hearing aid according to the invention the signal processor may be an analogue signal processor. In an even further embodiment of the binaural hearing aid according to the invention the communication between the two housing structures may be provided by a wire.

The at least one signal processor may further be adapted to compare evaluations of spectral and temporal modulations of the two input signals and the binaural hearing aid system may be adapted to switch between OMNI and DIR microphone modes in dependence of said comparison. Hereby, a binaural hearing aid is provided wherein it is possible to choose that microphone mode of each of the two microphone systems, which provides the best speech intelligibility for the user of said binaural hearing aid and thus a microphone configuration (i.e. operational state (OMNI or DIR) each microphone should operate in) that to a high degree is in agreement with user preferences in each single situation.

The binaural hearing aid described above may in a preferred embodiment be adapted to use the method according to the invention as described above. Hereby is achieved a binaural hearing aid that is adapted to automatically switch between OMNI and DIR modes in one or both of the microphone systems in dependence of spectral and temporal modulations of at least one, but preferably two, of the two input signals in order to achieve highest possible speech intelligibility, by a microphone configuration that is in compliance with user preferences.

Figure 2:
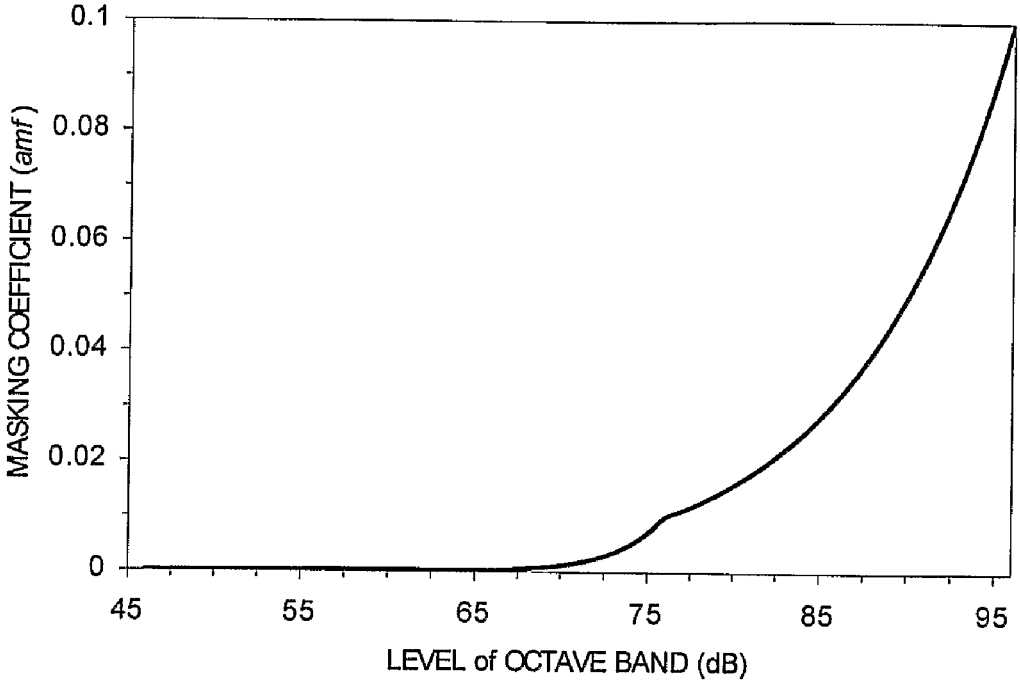
Figure 3:
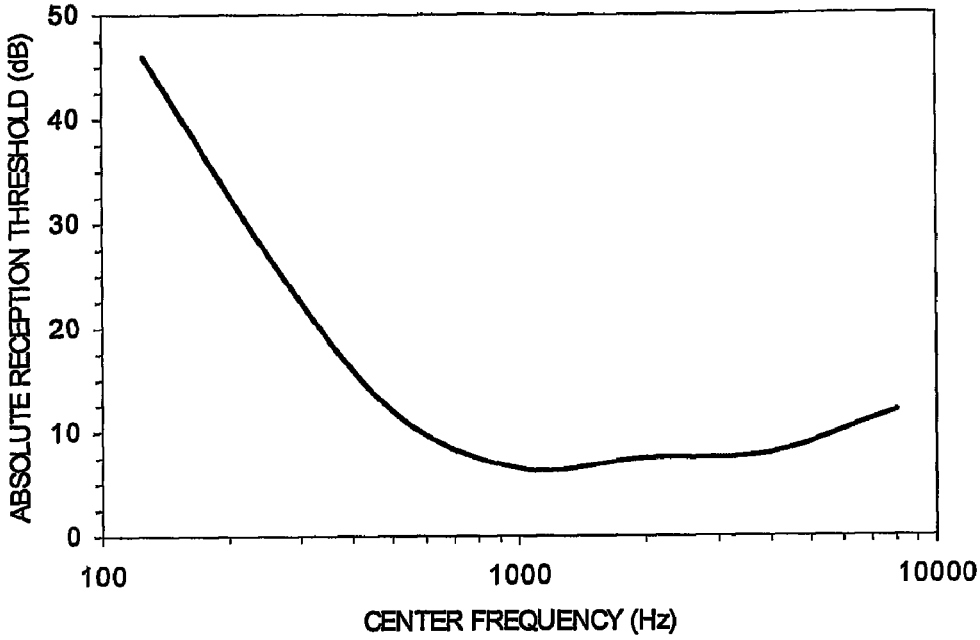
Figure 4:
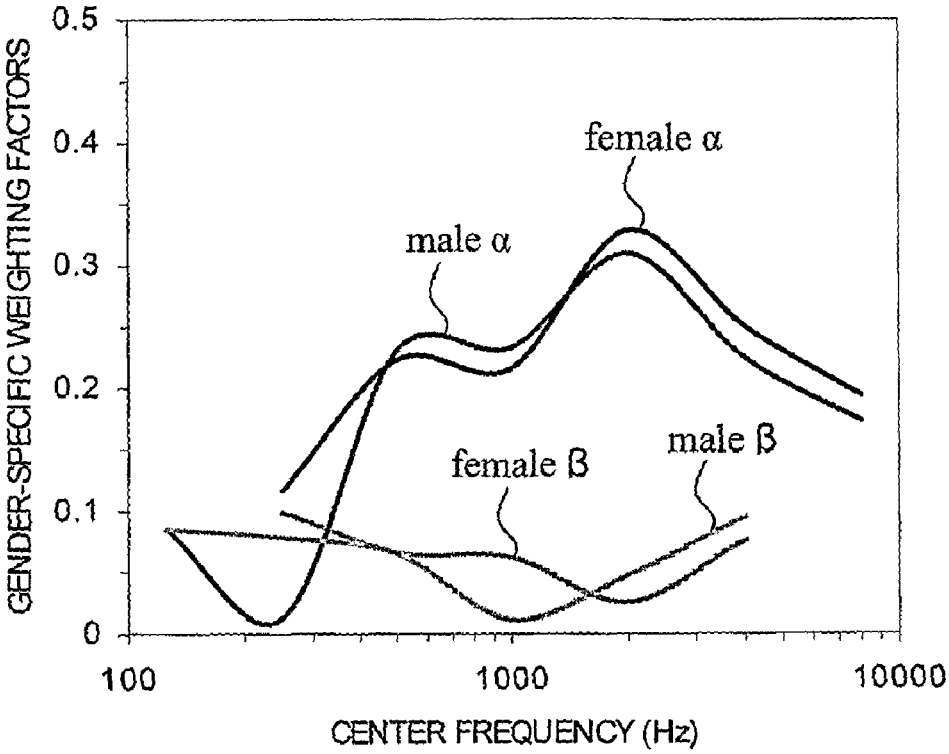
Figure 5:
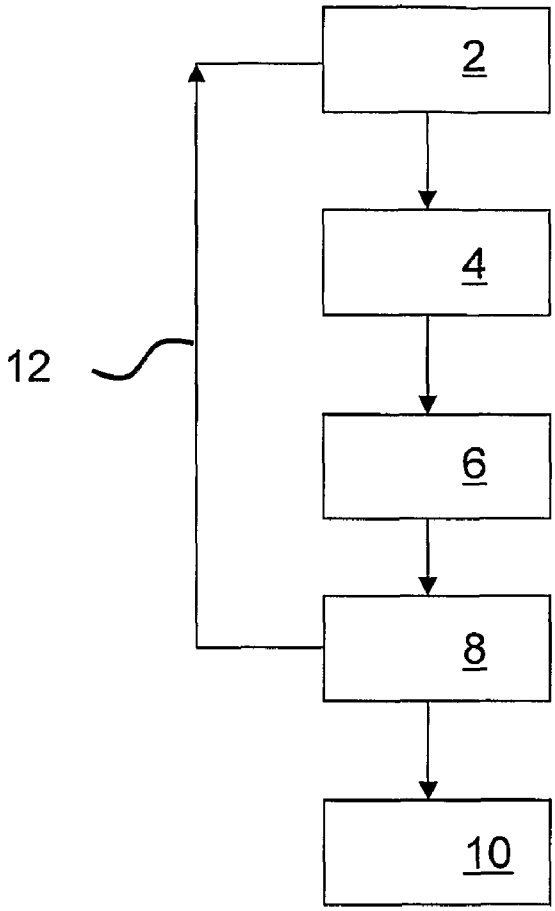
Figure 6:
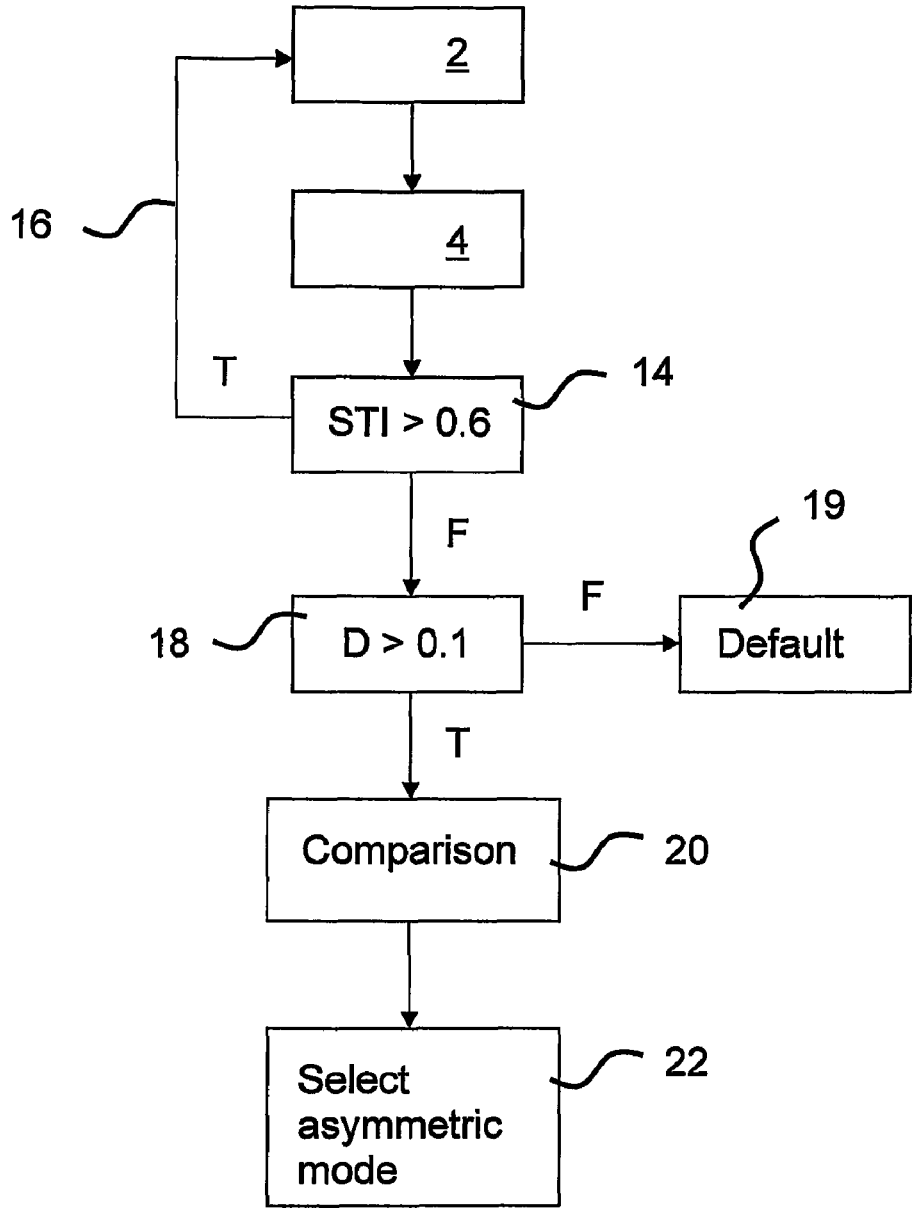
Figure 7:
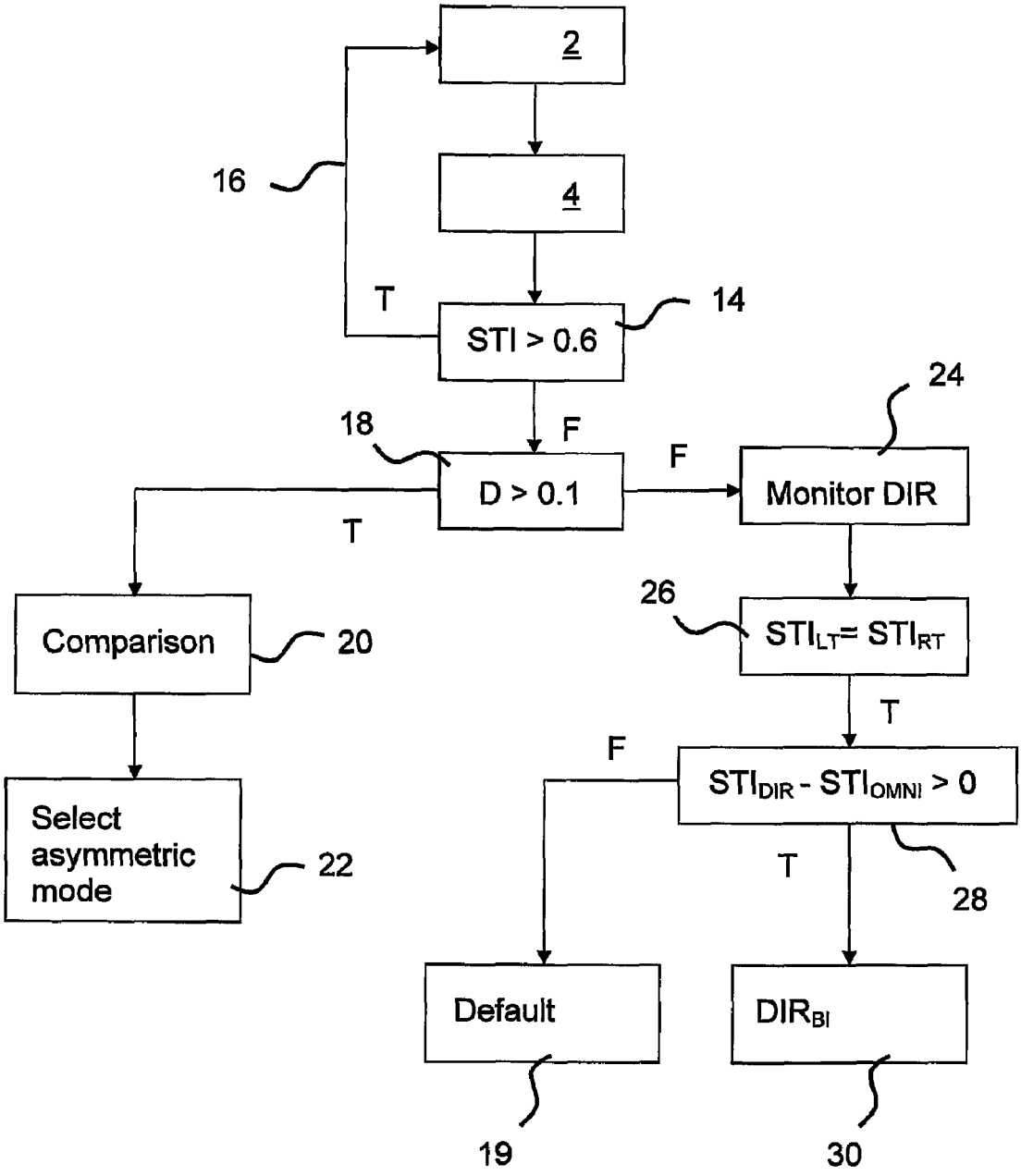
Figure 8:
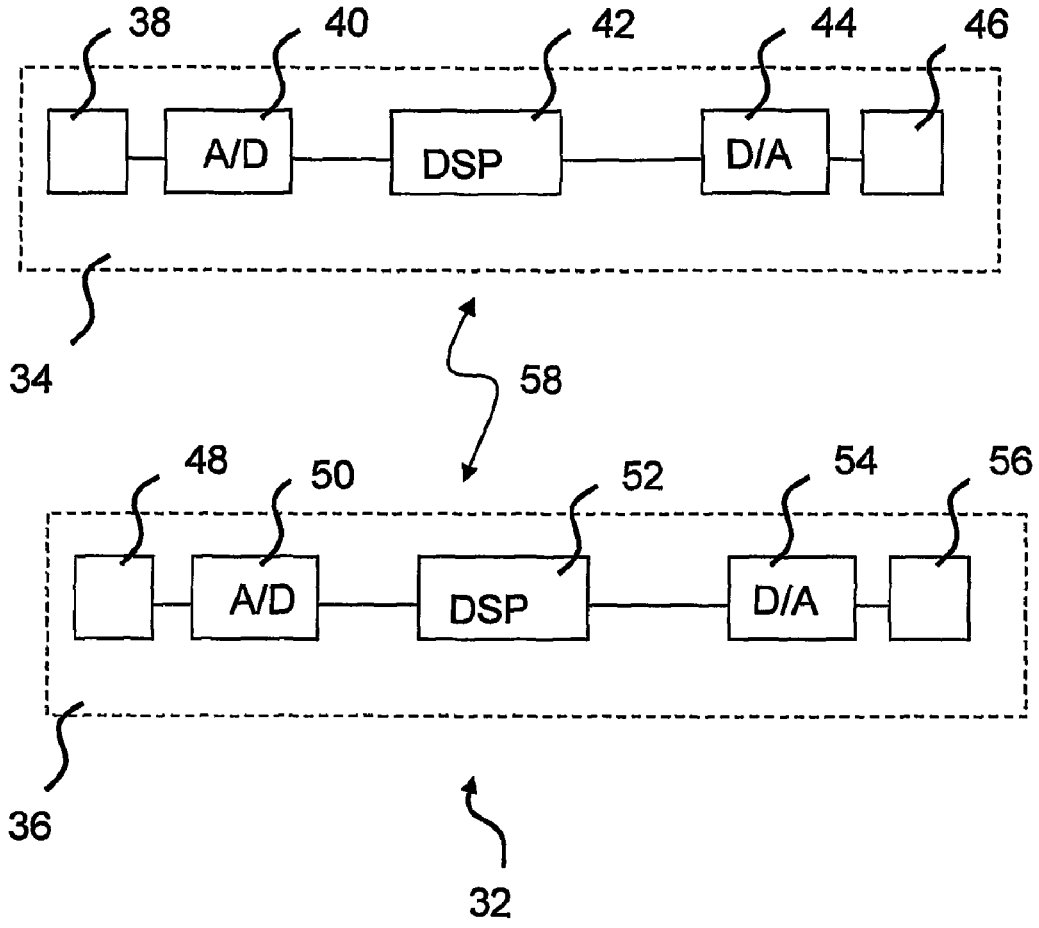

The above and other features and advantages of the present invention will become readily apparent to those skilled in the art by the following detailed description of exemplary embodiments thereof with reference to the attached drawings, in which:

FIG. 1 shows the sensitivity of the STMI metric to hearing-aid directionality, as well as spatial orientation of the signal and noise sources, FIG. 2 shows the auditory masking coefficients (amf) as a function of octave-band level, FIG. 3 shows the auditory reception threshold (ART) as a function of center frequency, FIG. 4 shows gender-specific weighting factors (octave, α, and redundancy, β) as a function of center frequency, FIG. 5 shows a simplified block diagram of a microphone switching algorithm according to the present invention, FIG. 6 is a block diagram illustrating a preferred embodiment of a microphone switching algorithm according to the inventive method, FIG. 7 is a block diagram illustrating another preferred embodiment of a microphone switching algorithm according to the inventive method, and FIG. 8 schematically illustrates a binaural hearing aid according to the invention.

The figures are schematic and simplified for clarity, and they merely show details which are essential to the understanding of the invention, while other details have been left out. Throughout, the same reference numerals are used for identical or corresponding parts.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the concept of the invention to those skilled in the art.

In the following description of the preferred embodiments primarily the use of a modified Speech Transmission Index (STI) as a fidelity measure in automatic switching between OMNI and DIR microphone modes is used, while it should be understood that other indexes that incorporate spectral and temporal modulations of the input signals, may be applied as well.

FIG. 1 shows the sensitivity of a STMI metric to hearing-aid directionality, as well as spatial orientation of the signal and noise sources. Each panel represents a separate experimental condition comparing DIR and OMNI processing of a speech signal in the presence of speech-shaped background noise at different speech-to-noise ratios. The data were obtained by recording the output of a hearing aid (modified GN ReSound Canta 770D) situated on the right ear of a KEMAR mannequin positioned in a sound-treated room having a loudspeaker on each wall. Recordings were made for each microphone processing mode then subjected to the STMI analysis. Data were obtained with KEMAR facing one loudspeaker arbitrarily designated as the "front" loudspeaker. Each panel represents a different location of the speech signal relative to KEMAR's orientation in the room. In the panel labeled "Signal from Front," the speech signal comes from in front of the mannequin and independent noise sources come from both the right and left side as well as from behind. In the panel labeled "Signal from Right," the speech signal is coming from the loudspeaker located on the mannequin's right side. Hence, the speech is now closest to the (right) ear fitted with the hearing aid, and the noise sources are coming from the front, rear, and left side of the mannequin. In the panel labeled "Signal from Left," the speech signal is coming from the left side of the mannequin and the noise emanates from the front, right, and rear. Because the hearing aid is fitted to the ear contralateral to the signal loudspeaker location, a significant head shadow is detected. As can be seen, when the speech is in the front, the $STMI_{DIR}$ (where $STMI_{DIR}$ means STMI measured in the directional microphone mode) is clearly superior to the $STMI_{OMNI}$ (where $STMI_{OMNI}$ means the STMI measured in the omnidirectional microphone mode). In contrast, the $STMI_{OMNI}$ is distinctly superior to the $STMI_{DIR}$ across a broad range of SNRs when the speech is coming from behind. Similarly, when the speech is coming from the ipsilateral (right) side closest to the hearing aid, $STMI_{OMNI}$ is superior to the $STMI_{DIR}$ across a broad range of SNRs. In this case, presumably, the DIR processing places a null in the direction of the speech signal (right side), resulting in a reduced $STMI_{DIR}$ relative to the OMNI processing. When the speech signal is coming from the contralateral (left) side, little difference in the STMI is observed between the two microphone modes. In this case, the $STMI_{OMNI}$ is reduced (relative to the ipsilateral side) because of the head shallow, and the DIR processing has little effect on the (contralateral) signal.

Based on this and other preliminary work, the STMI appears to show promise as a means for deciding which microphone mode to select as the listening environment changes. However, since the STMI metric may, as stated before, be computationally too intensive or complicated for use in some ordinary hearing aid we will in the following focus on two applications of a modified STI to the problem of automatic switching between OMNI and DIR microphone modes in a binaural hearing aid involving asymmetric fittings. The modified STI used in the two following implementations of the inventive method may comprise an ordinary STI as known in the art, that is modified to include a speech template, codebook or table of certain components of a speech signal that are common in any given language. The modified STI may also comprise different numbers of coefficients and bin sizes than the standard.

In both implementations, the binaural hearing aid according to the invention is set in the $OMNI_{BI}$ configuration only in quiet listening environments. When background noise is present, at least one of the microphone systems is set in the DIR mode, regardless of the location of the primary speech signal.

Before, the description of the preferred embodiment a more detailed description of the rationale of the STI metric will be explained: The metric needed to identify the key auditory scenes would naturally consist of temporal and spectral feature detectors and a clean speech template. Since, the microphone mode of a hearing aid alters two basic components that can affect speech reception for the hearing impaired, namely ambient (background) noise and reverberation (for more information see for example Ricketts T A, Dittberner A B: Directional amplification for improved signal-to-noise ratio: Strategies, measurements, and limitations. In Valente M, ed. *Hearing Aids: Standards, Options and Limitations*, second ed. New York: Thieme Medical Publishers, 2002: 274-346), there is a need for an evaluation index that can classify an environment based on the relationship of speech to reverberation and noise. Such an index is for example the speech transmission index (STI) (e. g. Steeneken, H., & Houtgast, T. 1980. A physical method for measuring speech-transmission quality. *Journal of the Acoustical Society of America,* 67, 318-326. IEC 60268-16. (2003). *Sound system equipment—Part* 16: *Objective rating of speech intelligibility by speech transmission index,* 3rd ed).

The STI is not sensitive to cross-channel jitter and other nonlinearities (for more information see for example: Hohmann, V., & Kollmeier, B. (1995). The effect of multichannel dynamic compression on speech intelligibility. *Journal of the Acoustical Society of America,* 97, 1191-1195., which can be introduced by the loudness compensation strategy of the device, and obscure the acoustic environment and its classification. Hence, the STI provides the best means to make decisions what microphone mode is best for a given acoustic environment.

Speech is a complex signal. Its cues come both from its temporal envelope and spectral fine structure (i.e., low-frequency modulations and high-frequency content). The computation of the STI may be based upon the modulation transfer function (MTF) at temporal (low) and spectral (high) frequency regions, which is derived from objective estimates of the signal-to-noise ratio (SNR).

The fundamental component of the STI is the modulation index, m, which is a function of both the modulation frequency, mf, and third-octave center frequency, cf. For example we may choose 14 modulation frequencies 0.63, 0.8, 1.0, 1.25, 1.6, 2.0, 2.5, 3.15, 4.0, 5.0, 6.3, 8, 10 and 12.5, with 7 center frequencies at 125, 250, 500, 1000, 2000, 4000 and 8000 Hz. These values may vary dependent upon the fidelity of the device; the width of the filters may also be dependent on device fidelity, the nature of the hearing impairment and the general acoustic attributes of speech.

The modulation index may then simply be calculated as the ratio of the intensity of the signal to the intensity of the signal and noise; that is:

$$m_{cf,mf}=I_{signal(cf,mf)}/[I_{signal(cf,mf)}+I_{noise(cf,mf)}] \quad (1)$$

There is a correction to this ratio to account for the upward spread of masking, which again may be corrected by an intensity-dependent auditory masking coefficient (amf): see for example FIG. 2 that shows the auditory masking coefficients (amf) as a function of octave-band level), and the addition of the intensity of the noise if the noise is greater than the absolute reception threshold ($I_{ART}$; see for example FIG. 3 that shows the auditory reception threshold (ART) as a function of center frequency):

$$m'_{cf,mf}=m_{cf,mf}\cdot I_{cf}/[I_{cf}+(amf\cdot I_{cf-1})+(I_{noise}\forall I_{noise}>I_{ART})] \quad (2)$$

The contribution of masking and noise in equation (2) above may be modified from the standard to account for changes in masking susceptibility in the peripherally impaired auditory system (Glasberg, B., & Moore, B. (1989). Psychoacoustic abilities of subjects with unilateral and bilateral cochlear hearing impairments and their relationship to the ability to understand speech. *Scandinavian Audiology, Supplement,* 32, 1-25).

From the corrected modulation index at each cf and mf, $m'_{cf,mf}$, the effective signal-to-noise ratio ($SNR_{cf,mf}$) may be computed according to the equation:

$$SNR_{cf,mf}=10\cdot\log_{10}[m'_{cf,mf}/(1-m'_{cf,mf})] \quad (3)$$

Based on the articulation index formulation of French and Steinberg (reported in: French, N., & Steinberg, J. (1947). Factors governing the intelligibility of speech sounds," *Journal of the Acoustical Society of America,* 19, 90-119), the range of SNR values useful for speech transmission is substantially in the range of −15 to +15 dB. Thus, a normalized transmission index ($TI_{cf,mf}$) may then be calculated according to the equation:

$$TI_{cf,mf}=(SNR_{cf,mf}+15\text{dB})/30\text{dB} \quad (4)$$

The modulation transfer index may then be calculated as the average of TIs across the modulation frequencies according to the equation:

$$MTI_{cf}=\frac{1}{14}\sum_{mf=1}^{14}TI_{cf,mf} \quad (5)$$

The STI is taken from the sum of TIs averaged across modulation frequencies with corrections for octave weighting (α) and redundancy (β; see for example FIG. 4), and may be calculated according to the equation:

$$STI_r=\sum_{cf=1}^{7}\alpha_{cf}MTI_{cf}-\sum_{cf=1}^{6}\beta_{cf}\sqrt{MTI_{cf}\cdot MTI_{(cf+1)}} \quad (6)$$

See for example FIG. 4 that shows gender-specific weighting factors (octave, α, and redundancy, β) as a function of center frequency.

In order to compute STI based on one of the two input signals, some estimate of a clean signal—"clean speech"—must be made, Instead of attempting to parse the input, one way of providing an estimate of a clean signal is to use a clean-speech template so that the STI of the acoustic environment—the denominator in equation (1)—can be properly estimated.

Corpuses of utterances by different genders (i.e., male and female), ages (i.e., child and adult), efforts (i.e., soft and loud) and languages are distilled into separate long-term intensity measurements ($I_{signal}$) at the same cf and mf values given above. These corpuses may be parsed by language, and may be averaged across gender and age. Because of the disparate difficulty in the classification of female and child speech (see for example Klatt & Klatt, 1990), a disproportionate amount of female and child speech samples may be used to derive each language's clean-speech template. Each clean-speech template may, in a sense, be a set of 98 coefficients (for example arranged as a 14×7 matrix) that is loaded into a soft-switching algorithm—more specifically, the modified STI or Evaluation Index (EI)—when the device is fitted (i.e., when the optimal language is determined).

In FIG. 5 is illustrated a simplified block diagram of a microphone switching algorithm according to the present invention. In the first block 2 the two microphone systems are set to an OMNI mode, i.e. in the first block the binaural hearing aid according to the invention is set to an $OMNI_{BI}$ mode. The second block 4 represents the measurement step, where the STI is monitored in at least one of the two input signals. Since the STI is monitored in the OMNI mode for both microphone systems in the binaural hearing aid a richer representation of the surrounding sound environment is achieved than would have been possible if one or both of the microphone systems were set in a DIR mode. This is partly due to the fact that the residual noise that is introduced to an input signal by a directional microphone is precluded and the fact that a directional microphone in its nature to a high degree sorts out sounds that emanates from some specific directions. The third block 6 represents an evaluation step, where the spectral and temporal modulations of the first and second input signal are evaluated by the calculation of an evaluation index for each of said signals. The block 8 represents an operational step, where the operational state of the two microphone systems is determined in dependence of the evaluation indexes that was calculated in the block 6. The block 8 has generally two main outputs, one of which being the operational state of the two microphone systems that determines an OMNI mode for each of the two microphone systems, i.e. a $OMNI_{BI}$ mode, as indicated with the arrow 12 that leads back to the block 2, that represents an $OMNI_{BI}$ microphone configuration. The other output of the block 8 is shown as the block 10 whish represents an operational state of the microphone systems wherein at least one of said microphone systems is set to a DIR mode. In general such a microphone configuration is favored in those situations where the measured modified STI is high, for example more than 0.5, preferably more than 0.6 or for example more than 0.7.

FIG. 6 is a block diagram illustrating a preferred embodiment of a microphone switching algorithm according to the inventive method. In this Implementation only switching from an $OMNI_{BI}$ $OMNI_{BI}$ microphone mode to an operating state of $OMNI_{RT}/DIR_{LT}$, or $DIR_{RT}/OMNI_{LT}$ is possible; that is, it does not provide for a $DIR_{BI}$ fitting, where the subscripts RT or LT refers to left or right ears respectively. It should be understood that any one of the first or second microphone systems may be adapted to provide an input signal to any of the two ears of a user. Since this embodiment of the invention does not provide for switching to a $DIR_{BI}$ microphone mode, it only requires that the STI be monitored/computed (in the background) only in the OMNI mode in each of the two microphone system. Hence, although this implementation allows many of the inherent problems of "symmetric" automatic switching to be avoided, it does not permit a $DIR_{BI}$ fit which may be beneficial in some specific circumstances. On the other hand, the signal processing requirements are in turn simpler, than if the possibility of switching to a $DIR_{BI}$ mode would be included.

As stated earlier, scientific investigations show that, when background noise is present and the speech is either in front of or behind the listener, it should make little difference which ear receives the OMNI processing and which ear receives the DIR processing. However, when the speech signal is to one side, head shadow effects come into play and the scientific investigations show that a user would prefer that the ear closest to the speech signal should receive the OMNI processing. The STI enables us to determine the preferred ear to receive OMNI processing by comparing the results across ears for the OMNI mode. If the difference between the $STI_{OMNI}$ for each ear is small, one can assume that the speech signal is coming from in front of or behind the listener. On the other hand, if the difference between $STI_{OMNI}$ across the ears is large, one can assume that the ear with the greater STI is closest to the speech signal and it should benefit from OMNI processing. Thus, the flow of the algorithm as showed in FIG. 6 would be as follows: The default mode for the hearing aid is set to be $OMNI_{BI}$, i.e. with both microphone systems in an OMNI mode, as indicated by block 2. The next block 4, indicates the step of monitoring the STI of each of the input signals in the OMNI mode. The $OMNI_{BI}$ mode may for example be selected automatically when the hearing aid is turned on. Next the STI of both input signals is compared to a first threshold value in block 14. This threshold value may be a suitably chosen value in the interval [0.5-0.9], preferably in the interval [0.5-0.8], for example 0.6 or 0.75. The first threshold value may in another embodiment be chosen in dependence of the individual hearing loss of the user. However, let us (for the sake of simplicity) in the following assume that a first threshold value of 0.6 is applicable. If $STI_{OMNI}$ exceeds 0.6 in both input signals (i.e. in or at both ears), then the scientific investigations show that we may assume that the user of the inventive hearing aid is surrounded by a relatively quiet environment and correspondingly the binaural hearing aid remains in the default $OMNI_{BI}$ configuration as indicated by the arrow 16 from block 14 to block 2. This corresponds to the situation where the criterion STI>first threshold value (=0.6 in this example) is fulfilled as indicated by a True (T) output. If on the other hand the criterion in block 14 is not fulfilled, i.e. the expression STI>first threshold value (=0.6 in this example) is false (F), as indicated by the output F, the scientific investigations show that we may assume that noise and/or reverberations are present, and the preparation of an asymmetric fit is initiated. First the difference D between the STI that is calculated from the two input signals is found and this difference D is then compared to a second threshold value in block 18. Mathematically the criterion may be expressed as whether the following inequality is fulfilled: D>second threshold value. This second threshold value may for example be a suitable value chosen from the interval [0.05-0.25], preferably from the interval [0.075-0.15]. In one embodiment of the invention the second threshold value may be chosen in dependence of the hearing loss of the user. As an illustrative example, the second threshold value will in the following be assumed to be 0.1. If the criterion in block 18 in not fulfilled, i.e. if the expression D>0.1 is false this is indicated by the output F of block 18. In the case that the output of block 18 is F, this is indicative of that the difference in STI between the two input signals is small, and a default asymmetric fit is chosen, i.e. the operating state of the microphone systems is chosen to be either $OMNI_{RT}/DIR_{LT}$ or $DIR_{RT}/OMNI_{LT}$. This default asymmetric mode is indicated by block 19. What the default asymmetric operating state should be in any specific case may be individualized, and chosen in dependence of the type and size of the individual hearing loss of the user, i.e. for example in dependence of what ear has the biggest hearing loss.

If on the other hand the $STI_{OMNI}$ difference across ears exceeds 0.1, the ear with greater STI receives OMNI processing and the contralateral ear receives DIR processing. This means that the expression D>0.1 is true, as indicated by the output T of block 18, where after the STI for both input signals, and thereby for both ears is compared in block 20, and the microphone system that generates the input signal with highest STI is set to an OMNI mode, while the other microphone system is set to operate in a DIR mode. This selection of the asymmetrical fit is indicated by block 22 in FIG. 6.

The Implementation of an algorithm according to the inventive method as indicated in FIG. 6 is based on the assumption that what you gain from an asymmetric fit (i.e., avoiding the possibility of setting the both hearing aids in the non-preferred microphone mode) is greater than the potential benefit of more typical binaural fits (i.e., either $DIR_{BI}$ or $OMNI_{BI}$).

FIG. 7 shows a block diagram illustrating another preferred embodiment of a microphone switching algorithm according to the inventive method, wherein it is possible to choose a $DIR_{BI}$ microphone mode in dependence of an evaluation of the spectral and temporal modulations of the input signals. Such an algorithm may be preferable if a $DIR_{BI}$ fitting frequently provides significantly greater benefit than an asymmetric fit, a more flexible fitting strategy than the implementation depicted in FIG. 6 may be necessary that allows for a $DIR_{BI}$ fitting under some circumstances. We can use the STI to choose when the binaural hearing aid according to the invention should select the $DIR_{BI}$ configuration, rather than an asymmetric configuration, i.e. $OMNI_{RT}/DIR_{LT}$, or $DIR_{RT}/OMNI_{LT}$. This implementation is similar in many respects to the implementation of the inventive method depicted in FIG. 6 except that both OMNI and DIR modes must be monitored in the background. Thus, in the following description focus will mainly be on the differences between these two algorithms.

As before the default mode for the binaural hearing aid is $OMNI_{BI}$, and the default mode for the asymmetric fit is specified as either $OMNI_{RT}/DIR_{LT}$ or $DIR_{RT}/OMNI_{LT}$, possibly depending upon patient preferences/needs. In the following description of the embodiment shown in FIG. 7, the same example values of the first and second threshold values as was used in the example description with respect to FIG. 6, i.e. it will in the following be assumed that the first threshold value is 0.6 and the second threshold value is 0.1.

The first steps in the algorithm shown in FIG. 7 are substantially the same as for the algorithm shown in FIG. 7. However, if the output of block 18 is false, i.e. if the expression D>0.1 is false, then the further processing of the algorithm is different. Thus, if $STMI_{OMNI}$ difference between ears is less than 0.1, the STI is monitored in a DIR mode, as indicated by block 24. Thereafter the STI for the two input signals, corresponding to left and right ear, respectively, is compared in order to evaluate whether the STI calculated from the input signal that corresponds to the left ear, $STI_{LT}$, is substantially equal to the $STI_{RT}$ calculated from the input signal that corresponds to the right ear (indicated by block 26). It is noted that one of the $STI_{LT}$ or $STI_{RT}$ is calculated from an OMNI input signal, and the other is calculated from a DIR signal.

If it is true (indicated by the output T of block 26) that $STI_{LT}$ is substantially equal to the $STI_{RT}$ then in the processing block 28, it is evaluated whether the expression $STI_{DIR}$-$STI_{OMNI}$>0 is true. If $STI_{DIR}$-$STI_{OMNI}$ is a positive number, then this is indicative of that the desired speech signal is in front of the user, and the operating state of the binaural hearing aid is chosen to be $DIR_{BI}$, i.e. both of the microphone systems is chosen to operate in a DIR mode. This is indicated by the block 30. However, if the expression $STI_{DIR}$-$STI_{OMNI}$>0 is false, indicated by the output F of block 28, this is indicative of the fact that the desired signal location is behind the user of the binaural hearing aid according to the invention, and then a default asymmetric microphone configuration is chosen. If the $STI_{DIR}$-$STI_{OMNI}$ is negative and unequal at the two ears, this would have been reflected in a difference in the $STI_{OMNI}$ between the two ears and the binaural hearing aid would have already selected an asymmetric fit.

Note that the decision to select the $DIR_{BI}$ configuration is conservative in that four conditions must be met. First, the $STI_{OMNI}$ score in both ears must be below 0.6 (noise present). Second, there must be a $STI_{OMNI}$ difference between ears of less than 0.1 (symmetrical signal input). Third, the $STI_{DIR}$-$STI_{OMNI}$ must be positive in both ears (desired signal in front of the user). Fourth, the magnitude of the STI must be equal at the two ears (symmetrical DIR benefit). As noted above, when the condition of block 28 is not met, i.e. the expression $STI_{DIR}$-$STI_{OMNI}$>0 is false, it is assumed that the desired signal source is located behind the listener. In this case, DIR processing is not likely to be beneficial in either ear and, it could be argued that an $OMNI_{BI}$ configuration might be optimal. Nevertheless, as currently envisioned, the inventive binaural hearing aid is configured in the fixed asymmetric setting. The rationale here is that, with noise present, the potential for directional benefit exists if the listener should turn to face the signal of interest. In this case, the inventive binaural hearing aid would already be configured for DIR processing in one ear, thus avoiding the processing delay that would be required to reconfigure the system from $OMNI_{BI}$ to a directional mode.

The scientific investigations have involved laboratory testing of speech recognition for four hearing aid fitting strategies ($OMNI_{BI}$, $DIR_{BI}$, $OMNI_{RT}$/$DIR_{LT}$, and $DIR_{RT}$/$OMNI_{LT}$) for speech stimuli presented from four source locations surrounding a listener. In addition, STI analyses have been carried out to determine whether STI scores accurately predict the performance differences observed in the behavioral data, across processing modes and source locations.

FIG. 8 schematically illustrates a binaural hearing aid 32 according to the invention. The binaural hearing aid 32 comprises a first housing structure 34 and a second housing structure 36.

The first housing structure 24 comprises a first microphone system 38 for the provision of a first input signal, an A/D converter 40 for converting the first input signal into a first digital input signal, a digital signal processor (DSP) 42 that is adapted to process the digitalized first input signal, a D/A converter 44 for converting the processed first digital input signal into a first analogue output signal. The first analogue output signal is then transformed into a first acoustical output signal (to be presented to a first ear of a user) in a first receiver 46.

Similarly the second housing structure 36 comprises a second microphone system 48 for the provision of a second input signal, an A/D converter 50 for converting the second input signal into a second digital input signal, a digital signal processor (DSP) 52 that is adapted to process the digitalized second input signal, a D/A converter 54 for converting the processed second digital input signal into a second analogue output signal. The second analogue output signal is then transformed into a second acoustical output signal (to be presented to a second ear of a user) in a second receiver 56. In a preferred embodiment of the invention, the first and second housing structures are individual hearing aids, possibly known in the art.

The binaural hearing aid 32 furthermore comprises a link 58, between the two housing structures 34 and 36. The link 58 is preferable wireless, but may in another embodiment be wired. The link 58 enables the two housing structures to communicate with each other, i.e. it may be possible to send information between the two housing structures via the link 58. The link 58, thus, enables the two digital signal processors, 42 and 52, to perform binaural signal processing according to the inventive method described above, wherein information derived from both microphone systems, 38, 48, is used in the signal processing in order to determine the operating state (OMNI or DIR) of each of the microphone systems 38, 48, that provides the user with optimal speech intelligibility in compliance with user preferences.

As illustrated above, the use of spectral and temporal modulations of the input signals of a binaural hearing aid is feasible and may be used to predict beneficial microphone configurations in compliance with user preferences. However, as will be understood by those familiar in the art, the present invention may be embodied in other specific forms and utilize any of a variety of different algorithms without departing from the spirit or essential characteristics thereof. For example the selection of an algorithm may typically application and/or user specific, the selection depending upon a variety of factors including the size and type of the hearing loss of the user, the expected processing complexity and computational load. Accordingly, the disclosures and descriptions herein are intended to be illustrative, but not limiting, of the scope of the invention which is set forth in the following claims.

The invention claimed is:

1. A method of automatic switching between an omnidirectional (OMNI) microphone mode and a directional (DIR) microphone mode in a binaural hearing aid comprising a first microphone system for provision of a first input signal, a second microphone system for provision of a second input signal, where the first microphone system is adapted to be placed in or at a first ear of a user, the second microphone system is adapted to be placed in or at a second ear of said user, the method comprising:

obtaining spectral and temporal modulations of the first input signal and the second input signal;

evaluating the spectral and temporal modulations of the first input signal and the second input signal, wherein the act of evaluating comprises calculating a first evaluation index of speech intelligibility for the first input signal, calculating a second evaluation index of speech intelligibility for the second input signal, comparing the first evaluation index for the first input signal with a first threshold value, and comparing the second evaluation index for the second input signal with the first threshold value; and setting the binaural hearing aid to the omnidirectional (OMNI) microphone mode or to the directional (DIR) microphone mode based on a result from the act of evaluating.

2. The method according to claim 1, wherein the act of setting the binaural hearing aid comprises setting at least one of the first microphone system and the second microphone system to the directional (DIR) microphone mode when a result from at least one of the acts of comparing indicates low speech intelligibility.

3. The method according to claim 1, wherein the act of evaluating further comprises calculating a difference between the first evaluation index and the second evaluation index, and comparing the difference with a second threshold value.

4. The method according to claim 3, wherein the act of setting the binaural hearing aid comprises setting one of the first microphone system and the second microphone system to the directional (DIR) microphone mode, and setting the other one of the first microphone system and the second microphone system to the omnidirectional (OMNI) microphone mode when the difference between the first evaluation index and the second evaluation index is less than the second threshold value.

5. The method according to claim 1, wherein the act of evaluating further comprises calculating a third evaluation index for the omnidirectional (OMNI) microphone mode and a fourth evaluation index for the directional (DIR) microphone mode for the first microphone system and the second microphone system; and wherein the act of setting the binaural hearing aid comprises setting the first microphone system and the second microphone system in the directional (DIR) microphone mode when a difference between the fourth evaluation index for the directional (DIR) microphone mode and the third evaluation index for the omnidirectional (OMNI) microphone mode for the first microphone system and the second microphone system indicates better speech intelligibility.

6. The method according to claim 3, wherein, when the difference between the first evaluation index and the second evaluation index is greater than the second threshold value, the act of setting the binaural hearing aid comprises:

setting one of the first microphone system and the second microphone system with a corresponding one of the first evaluation index and the second evaluation index indicating highest speech intelligibility to the omnidirectional (OMNI) microphone mode, and setting the other one of the first microphone system and the second microphone system with a corresponding one of the first evaluation index and the second evaluation index indicating lowest speech intelligibility to the directional (DIR) microphone mode.

7. The method according to claim 1, wherein the act of obtaining the spectral and temporal modulations of each of the first input signal and the second input signal is performed with at least one of the first microphone system and the second microphone system being in the omnidirectional (OMNI) microphone mode.

8. The method according to claim 1, wherein the act of obtaining the spectral and temporal modulations of each of the first input signal and the second input signal is performed with one of the first microphone system and the second microphone system being in the omnidirectional (OMNI) microphone mode and the other one of the first microphone system and the second microphone system being in the directional (DIR) microphone mode.

9. The method according to claim 1, wherein the first evaluation index of speech intelligibility is selected from the group consisting of: a speech transmission index (STI), a modified speech transmission index (mSTI), a spectral temporal modulation index (STMI), a modified temporal modulation index (mSTMI), an articulation index (AI), and a modified articulation index (mAI).

10. A binaural hearing aid comprising:

at least one signal processor, a first microphone system for provision of a first input signal, a second microphone system for provision of a second input signal, where the first microphone system is adapted to be placed in or at a first ear of a user, the second microphone system is adapted to be placed in or at a second ear of said user, wherein the at least one signal processor is configured to perform the method according to claim 1.

11. A hearing aid comprising:

a signal processor and a microphone system for provision of an input signal, the hearing aid being a part of a binaural hearing aid and is configured for receiving information from another hearing aid of the binaural hearing aid, wherein the signal processor is configured to perform the method according to claim 1.

12. The method of claim 1, wherein the act of setting the binaural hearing aid comprises setting the binaural hearing aid to the omnidirectional (OMNI) microphone mode when a result from the act of evaluating indicates high speech intelligibility.

13. The method according to claim 1, wherein each of the first evaluation index and the second evaluation index has a value that is anywhere from 0 to 1.

14. A binaural hearing aid comprising:

at least one signal processor;

a first microphone system for provision of a first input signal;

a second microphone system for provision of a second input signal, where the first microphone system is adapted to be placed in or at a first ear of a user, the second microphone system is adapted to be placed in or at a second ear of said user;

wherein the at least one signal processor is configured for:

obtaining spectral and temporal modulations of the first input signal and the second input signal;

evaluating the spectral and temporal modulations of the first input signal and the second input signal by calculating a first evaluation index of speech intelligibility for the first input signal, calculating a second evaluation index of speech intelligibility for the second input signal, comparing the first evaluation index for the first input signal with a first threshold value, and comparing the second evaluation index for the second input signal with the first threshold value; and setting the binaural hearing aid to an omnidirectional (OMNI) microphone mode or to a directional (DIR) microphone mode based on a result from the act of evaluating.

15. The binaural hearing aid according to claim 14, wherein the at least one processor is configured for obtaining the spectral and temporal modulations of each of the first input signal and the second input signal when at least one of the first microphone system and the second microphone system is in the omnidirectional (OMNI) microphone mode.

16. The binaural hearing aid according to claim 14, wherein the at least one processor is configured for obtaining the spectral and temporal modulations of each of the first input signal and the second input signal when one of the first microphone system and the second microphone system is in the omnidirectional (OMNI) microphone mode, and the other one of the first microphone system and the second microphone system is in the directional (DIR) microphone mode.

17. The binaural hearing aid according to claim 14, wherein the first evaluation index of speech intelligibility is selected from the group consisting of: a speech transmission index (STI), a modified speech transmission index (mSTI), a spectral temporal modulation index (STMI), a modified temporal modulation index (mSTMI), an articulation index (AI), and a modified articulation index (mAI).

18. The binaural hearing aid according to claim 14, wherein the at least one processor is configured for setting the binaural hearing aid by setting at least one of the first microphone system and the second microphone system to the directional (DIR) microphone mode when a result from at least one of the acts of comparing indicates low speech intelligibility.

19. The binaural hearing aid according to claim 14, wherein the at least one processor is configured for performing the act of evaluating by further calculating a difference between the first evaluation index and the second evaluation index, and comparing the difference with a second threshold value.

20. The binaural hearing aid according to claim 19, wherein the at least one processor is configured for setting the binaural hearing aid by setting one of the first microphone system and the second microphone system to the directional (DIR) microphone mode, and setting the other one of the first microphone system and the second microphone system to the omnidirectional (OMNI) microphone mode when the difference between the first evaluation index and the second evaluation index is less than the second threshold value.

21. The binaural hearing aid according to claim 19, wherein, when the difference between the first evaluation index and the second evaluation index is greater than the second threshold value, the at least one processor is configured for setting the binaural hearing aid by:

setting one of the first microphone system and the second microphone system with a corresponding one of the first evaluation index and the second evaluation index indicating highest speech intelligibility to the omnidirectional (OMNI) microphone mode, and setting the other one of the first microphone system and the second microphone system with a corresponding one of the first evaluation index and the second evaluation index indicating lowest speech intelligibility to the directional (DIR) microphone mode.

22. The binaural hearing aid according to claim 14, wherein the at least one processor is configured to perform the act of evaluating by further calculating a third evaluation index for the omnidirectional (OMNI) microphone mode and a fourth evaluation index for the directional (DIR) microphone mode for the first microphone system and the second microphone system; and wherein the at least one processor is configured for setting the binaural hearing aid by setting the first microphone system and the second microphone system in the directional (DIR) microphone mode when a difference between the fourth evaluation index for the directional (DIR) microphone mode and the third evaluation index for the omnidirectional (OMNI) microphone mode for the first microphone system and the second microphone system indicates better speech intelligibility.

23. The binaural hearing aid according to claim 14, wherein the at least one processor is configured for setting the binaural hearing aid to the omnidirectional (OMNI) microphone mode when a result from the act of evaluating indicates high speech intelligibility.

24. The binaural hearing aid according to claim 14, wherein each of the first evaluation index and the second evaluation index has a value that is anywhere from 0 to 1.

* * * * *